US007429955B2

(12) United States Patent
Tai et al.

(10) Patent No.: US 7,429,955 B2
(45) Date of Patent: Sep. 30, 2008

(54) MULTI-BAND ANTENNA

(75) Inventors: Lung-Sheng Tai, Tu-Cheng (TW); Po-Kang Ku, Tu-Cheng (TW); Chen-Ta Hung, Tu-Cheng (TW); Yun-Long Ke, Tu-Cheng (TW); Yao-Shien Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 67 days.

(21) Appl. No.: 11/507,834

(22) Filed: Aug. 22, 2006

(65) Prior Publication Data

US 2007/0040750 A1 Feb. 22, 2007

(30) Foreign Application Priority Data

Aug. 22, 2005 (TW) ..... 94128540 A

(51) Int. Cl.
*H01Q 1/24* (2006.01)

(52) U.S. Cl. ..... 343/702; 343/700 MS; 343/846

(58) Field of Classification Search ..... 343/702, 343/700 MS, 846
See application file for complete search history.

(56) References Cited

U.S. PATENT DOCUMENTS

| | | | | |
|---|---|---|---|---|
| 6,982,675 | B2 * | 1/2006 | Kwak et al. | 343/702 |
| 7,034,754 | B2 * | 4/2006 | Hung et al. | 343/700 MS |
| 7,170,452 | B2 * | 1/2007 | Yang | 343/702 |
| 2005/0134509 | A1 * | 6/2005 | Lin | 343/702 |
| 2006/0038721 | A1 * | 2/2006 | Ozkar et al. | 343/700 MS |

* cited by examiner

*Primary Examiner*—Tan Ho
(74) *Attorney, Agent, or Firm*—Wei Te Chung

(57) ABSTRACT

A multi-band antenna used in an electronic device, comprising: a grounding element; a radiating element comprises a first radiating section operating at 900 MHz frequency band and a second radiating section operating at 1800 MHz frequency band; and a connecting section connecting the radiating element and the grounding element. The grounding element, the radiating element, and the connecting element locate respectively in the different plane. The whole structure of the multi-band antenna of the present invention designed combining the inner structure of the notebook or other portable electrical device. The multi-band antenna is suit to be installed in a notebook or other portable electrical device because the multi-band antenna occupies small space.

17 Claims, 9 Drawing Sheets

MULTI-BAND ANTENNA

BACKGROUND OF THE INVENTION

1. Field of the Invention

The present invention relates generally to an antenna, and more particularly to a multi-band antenna used in a portable electronic device.

2. Description of the Prior Art

With the development of wireless communication, more and more portable electronic devices, such as a notebook, install an antenna system for working in a Wireless Local-area Network (WLAN). Transmitting and receiving signals plays an important role in wireless communication process. In recent years, a majority of WLAN bases on Bluetooth technical standard or 802.11 technical standard. Antenna in Bluetooth technical standard is based on 2.4 GHz frequency band, and in 802.11 technical standard is based on 2.4 GHz and 5 GHz. So, antenna in notebook mostly works at the above frequency bands at the present time.

However, an antenna used in a notebook is limited by the inner space of the notebook. So, the size of the antenna must be designed to be suitable for the inner space of the notebook. Most conventional antennas having big structure go against miniaturization development of portable electrical device.

For example, U.S. Pat. No. 6,861,986 B2 discloses a PIFA (Planar Inverted-F Antenna) capable of working on two different frequency bands. The PIFA antenna comprises a conductive radiating element 3 in the form of a wire that extends in a longitudinal direction and that has opposite first and second ends 31, 32. So, the PIFA antenna occupying big space in longitudinal direction goes against miniaturization development of portable electrical device.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna with compact structure and fitting to be installed in a notebook or other portable electrical devices.

In order to implement the above object and overcome the above-identified deficiencies in the prior art, the multi-band antenna formed in a metal patch, comprises a grounding element, a radiating element comprising a first radiating section operating at 900 MHz frequency band and a second radiating section operating at 1800 MHz frequency band; and a connecting element connecting the radiating section and the grounding section. The grounding element, the radiating element, and the connecting element locate respectively in the different plane.

Other objects, advantages and novel features of the invention will become more apparent from the following detailed description of a preferred embodiment when taken in conjunction with the accompanying drawings.

DETAILED DESCRIPTION OF THE INVENTION

Figure 1:
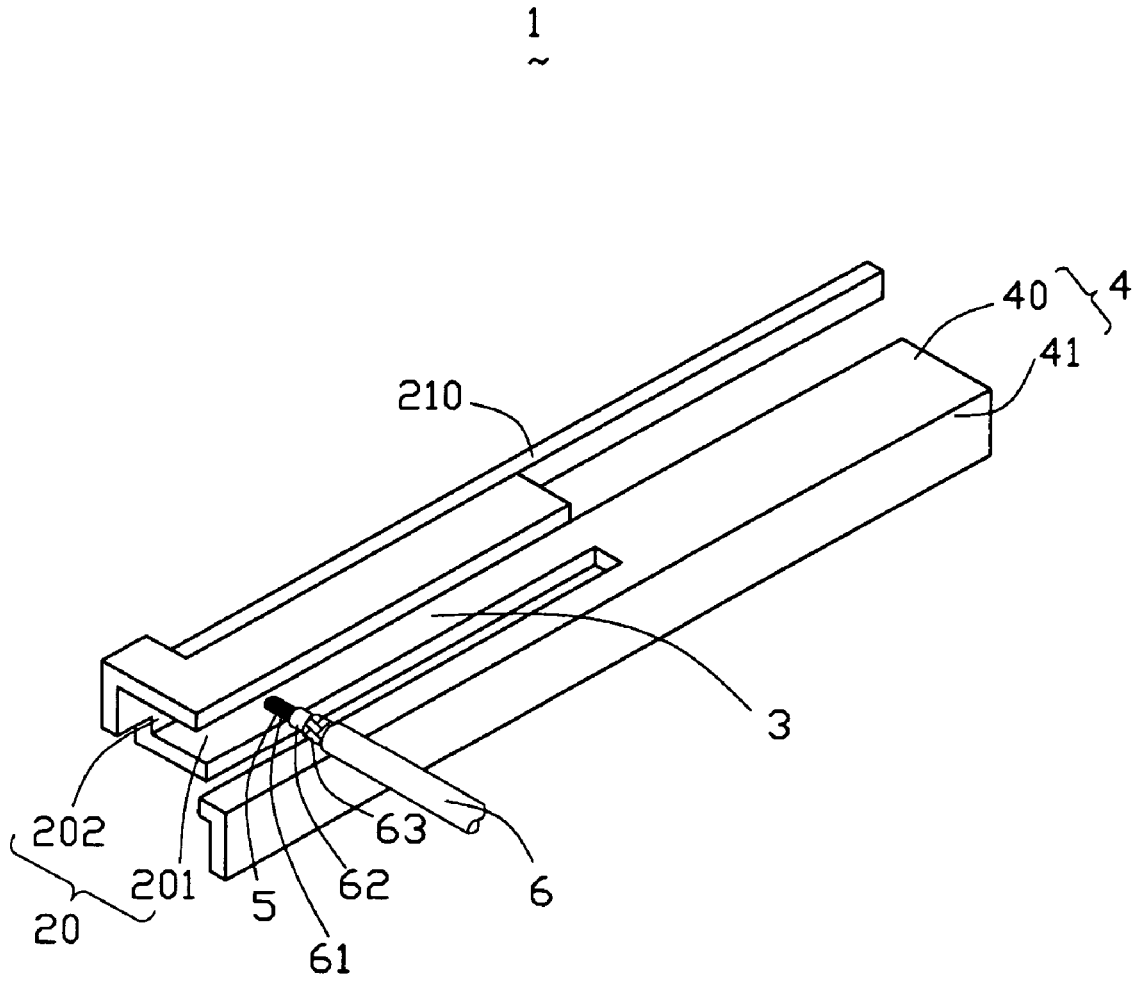
FIG. 1 is a perspective view of a multi-band antenna in accordance with the present invention.
Figure 2:
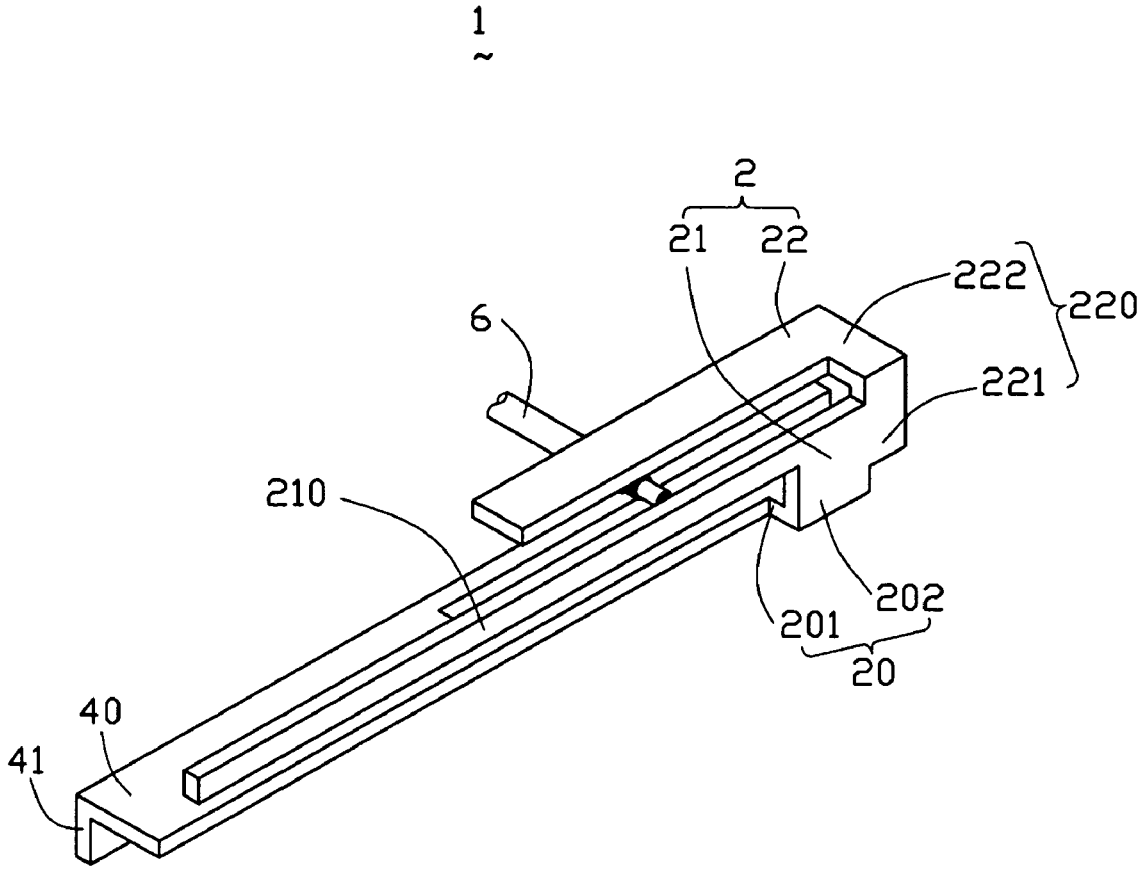
FIG. 2 is a perspective view similar to FIG. 1, but take from a different direction.
Figure 3:
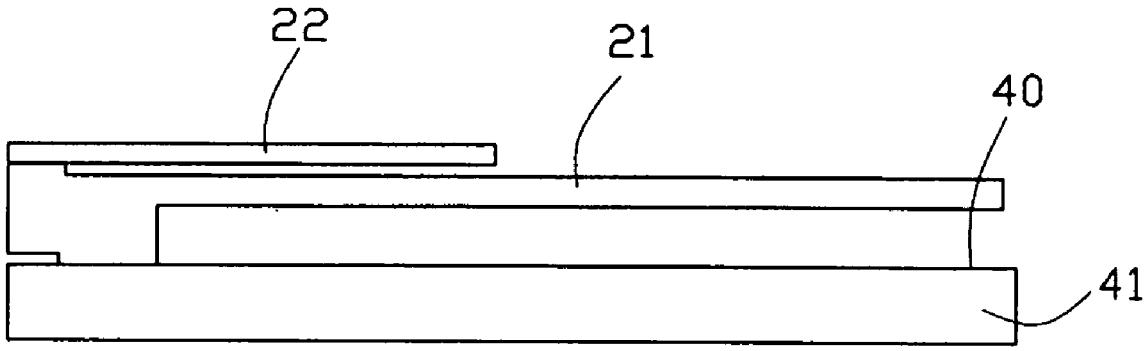
FIG. 3 is a front elevation view of FIG. 1 with feeding line not shown.
Figure 4:
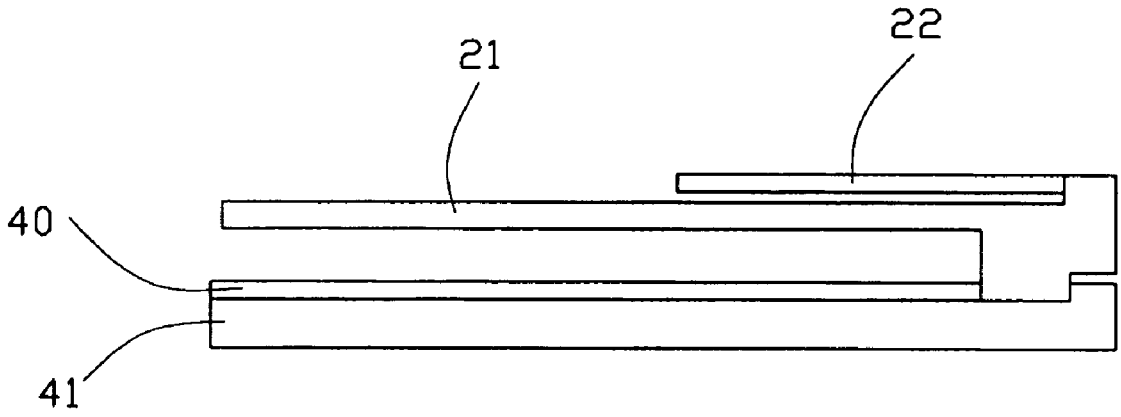
FIG. 4 is a similar to FIG. 3, but viewed from a different aspect.
Figure 5:
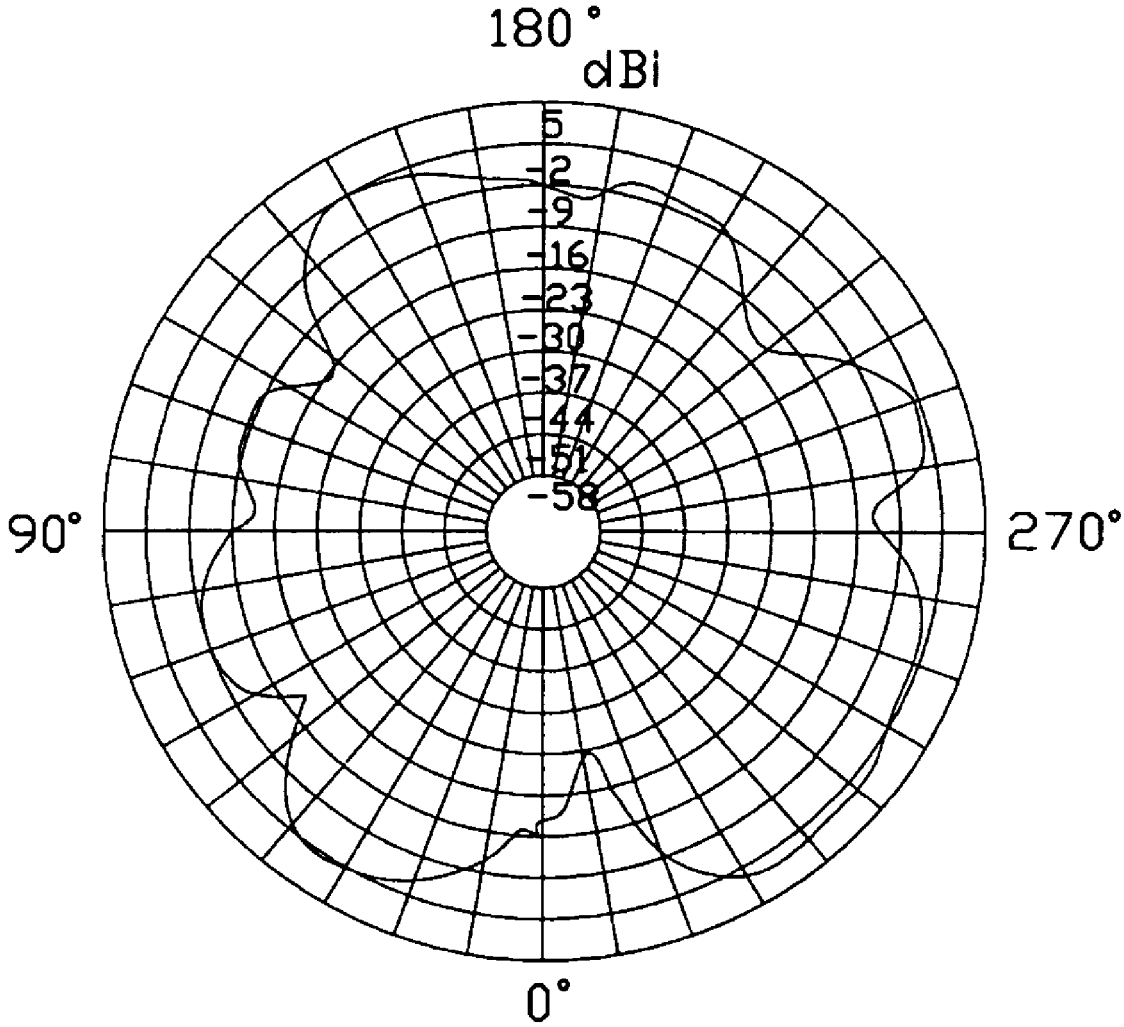
FIG. 5 is a horizontally polarized principle plane radiation pattern of the multi-band antenna operating at the resonant frequency of 900 MHz.
Figure 6:
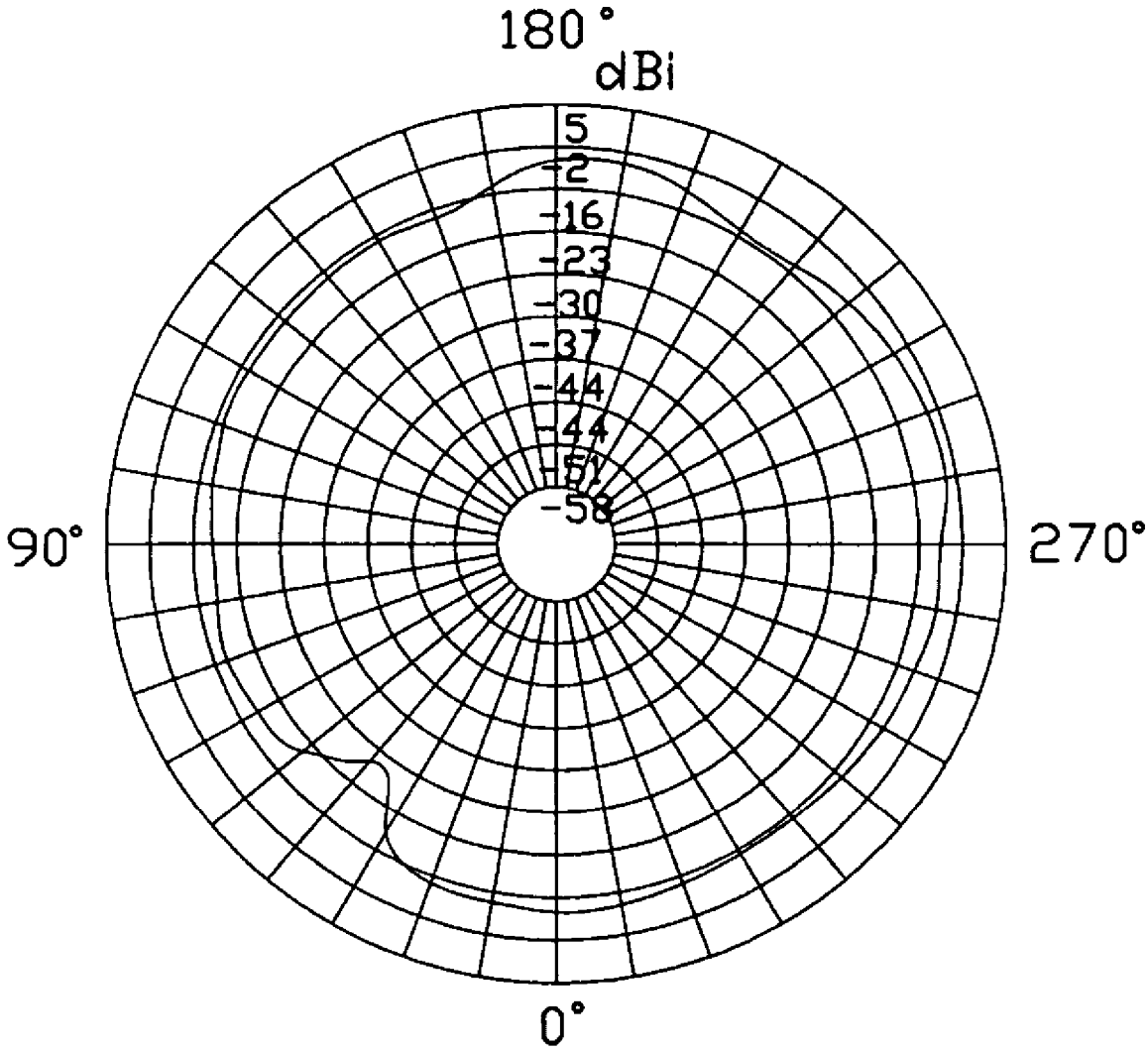
FIG. 6 is a vertically polarized principle plane radiation pattern of the multi-band antenna operating at the resonant frequency of 900 MHz.
Figure 7:
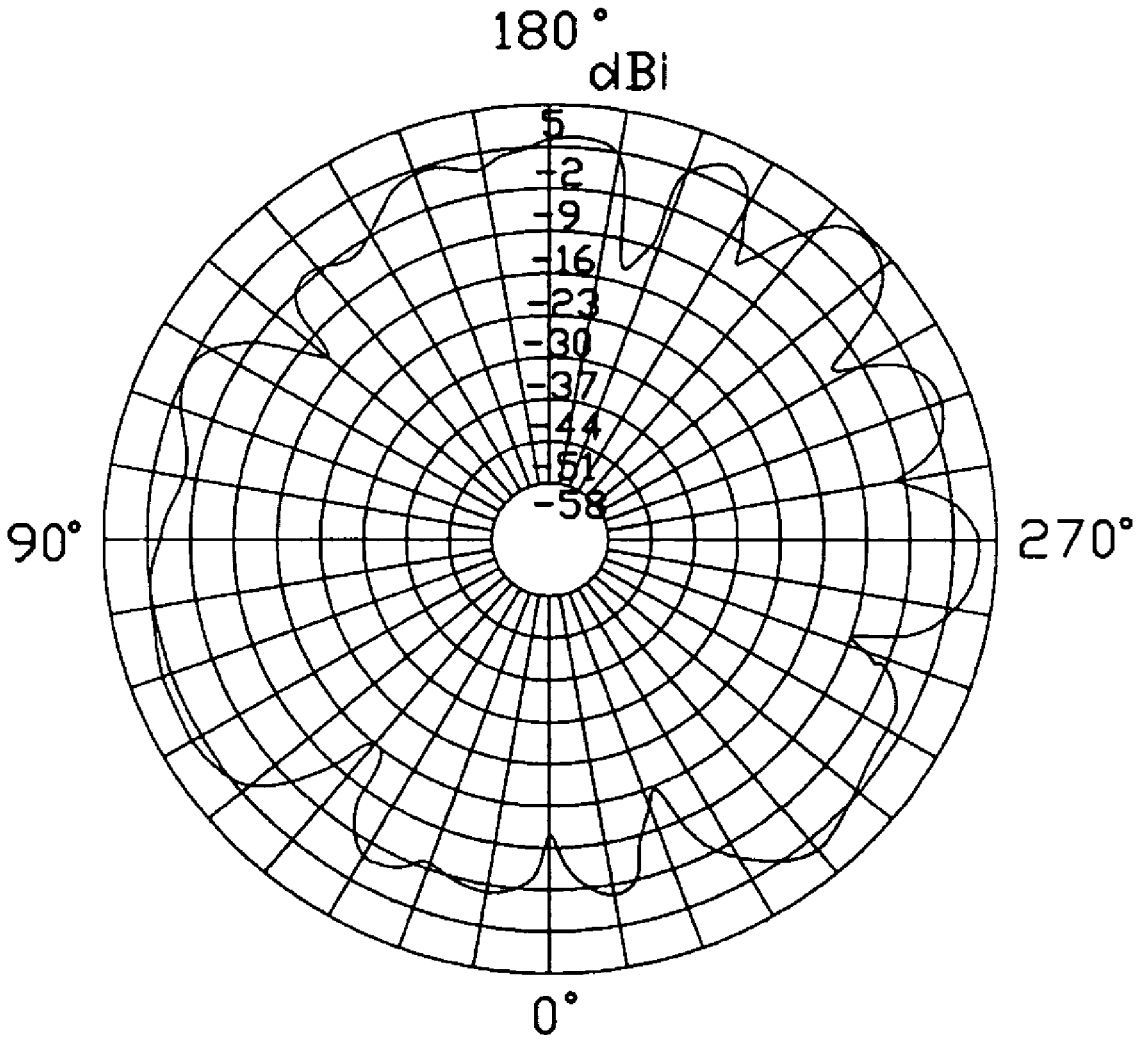
FIG. 7 is a horizontally polarized principle plane radiation pattern of the multi-band antenna operating at the resonant frequency of 1800 MHz.
Figure 8:
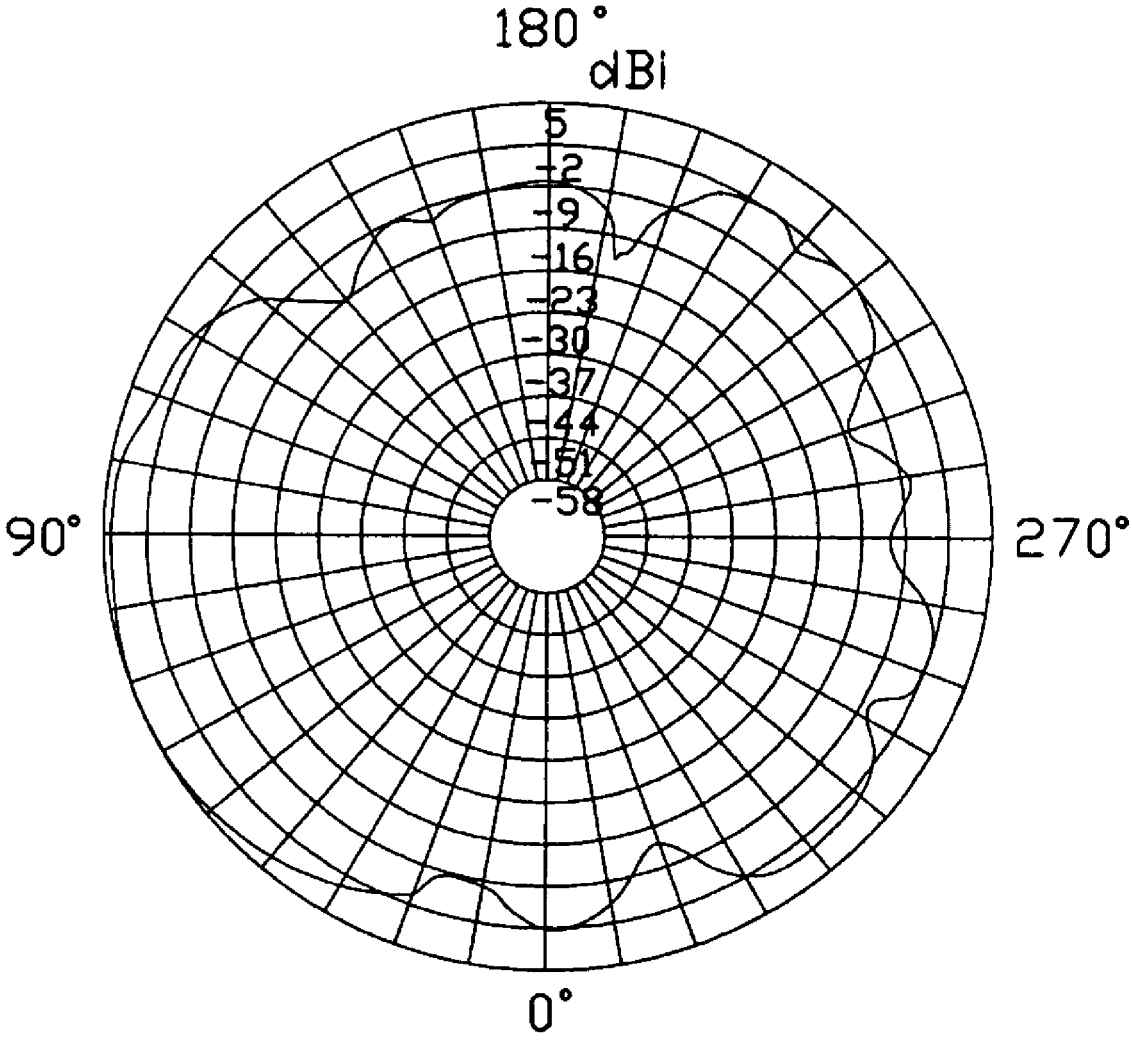
FIG. 8 is a vertically polarized principle plane radiation pattern of the multi-band antenna operating at the resonant frequency of 5.1800 MHz.

Reference will now be made in detail to a preferred embodiment of the present invention.

Referring to FIG. 1 to FIG. 4, a multi-band antenna 1 according to the present invention is made of a metal patch and shows a longitudinal structure along a longitudinal direction. The multi-band antenna 1 comprises a radiating element 2, a grounding element 4, a feeding line 6, and a connecting element 3 connecting the radiating element 2 and the grounding element 4.

The radiating element 2 comprises a first radiating section 21 operating at a lower frequency and a second radiating section 22 operating at a higher frequency. The first radiating section 21 and the second radiating section 22 extend along one common direction. The first radiating section 21 comprises a common radiating arm 20 and a first radiating arm 210 extending from the common radiating arm 20. The second radiating section 22 comprises the common radiating arm 20 and a second radiating arm 220 extending from the common radiating arm 20. The first radiating arm 210 and the second radiating arm 220 extend toward the same direction, such arrangement optimizes the inner space of the notebook or other portable electrical devices and reduces occupied space of the multi-band antenna 1.

The grounding element 4 comprises an inverted L-shape main body 40 defining a short edge and a long edge and a stretching section 41 bending from the long edge of the main body 40. The main body 40 and the stretching section 41 are respectively located in different planes. The connecting element 3 extends from the short edge of the main body 40 along a longitudinal direction and forms a slot with the long edge of main body 40.

A feeding point 5 adjustably locates on the joint of the common radiating arm 20 and the connecting element 3. The radiating trace from the right end of the first radiating section 21 to the feeding point 5 is longer than the radiating trace from the right end of the second radiating section 22 to the feeding point 5 and is also longer than the total length along longitudinal direction of the multi-band antenna 1.

The common radiating arm 20 connects with left ends of the first and second radiating sections 21, 22 and comprises a first side branch 201 and a second side branch 202. The first side branch 201 is of L-shape located in a first plane as that of the connecting element 3 and connects to the connecting element 3. The second side branch 202 extends upwards from the first side branch 201 and is located in a second plane. The first radiating arm 210 extends away from an upright edge of the second side branch 202 toward the main body 40 of the grounding element 4 and locates in the second plane as that of the second side branch 202. The second radiating arm 220 comprises a first side arm 221 and a second side arm 222. The first side arm 221 is of L-shape extending from opposite upright edge of the second side branch 202 along a direction opposite to that of the first radiating arm 210 and locates in the second plane as that of the second side branch 202 and the radiating arm 210. The second side arm 222 is of L-shape and extends from the first side arm 221 to be located in a third plane parallel to the first plane and perpendicular to the second plane. The first radiating section 21, the connecting element 3 and the grounding element 4 formed a first antenna receiving and transmitting low frequency signal and operating at 900 MHz. The second radiating section 22, the connecting element 3, and the grounding element 4 formed a second antenna receiving and transmitting high frequency signal and operating at 1800 MHz.

The high frequency band of the second antenna can achieve more broader breadth frequency band and better radiating effect by modulating the breadth of the slot and the location of the feeding point 5.

A feeding line 6 extending from the feeding point 5 is of a coaxial cable and comprises an inner conductor 61 soldered to the feeding point 5, an isolate inner layer 63 coving the inner conductor 61, a metal braiding layer 62 soldered to the grounding element 4 and an outer jacket 63.

The design of the whole structure of the multi-band antenna 1 suites to the inner structure of the notebook or other portable electrical device. The main body 41 of the grounding element 4 and the first side branch 201 locate in the first plane. The first radiating arm 210, the second side branch 202, and the first side arm 221 locate in the second plane. The second side arm 222 locates in the third plane. The multi-band antenna 1 is suitable to be installed in a notebook or other portable electrical device because of the compact structure of the multi-band antenna 1.

FIGS. 5-8 show the horizontally polarized and vertically polarized principle plane radiation patterns of the multi-band antenna 1 operating at the resonant frequencies of 900 MHz and 1800 MHz. Note that each radiation pattern of the multi-band antenna 1 is close to corresponding optimal radiation pattern and there is no obvious radiating blind area, conforming to the practical condition of an antenna.

Figure 9:
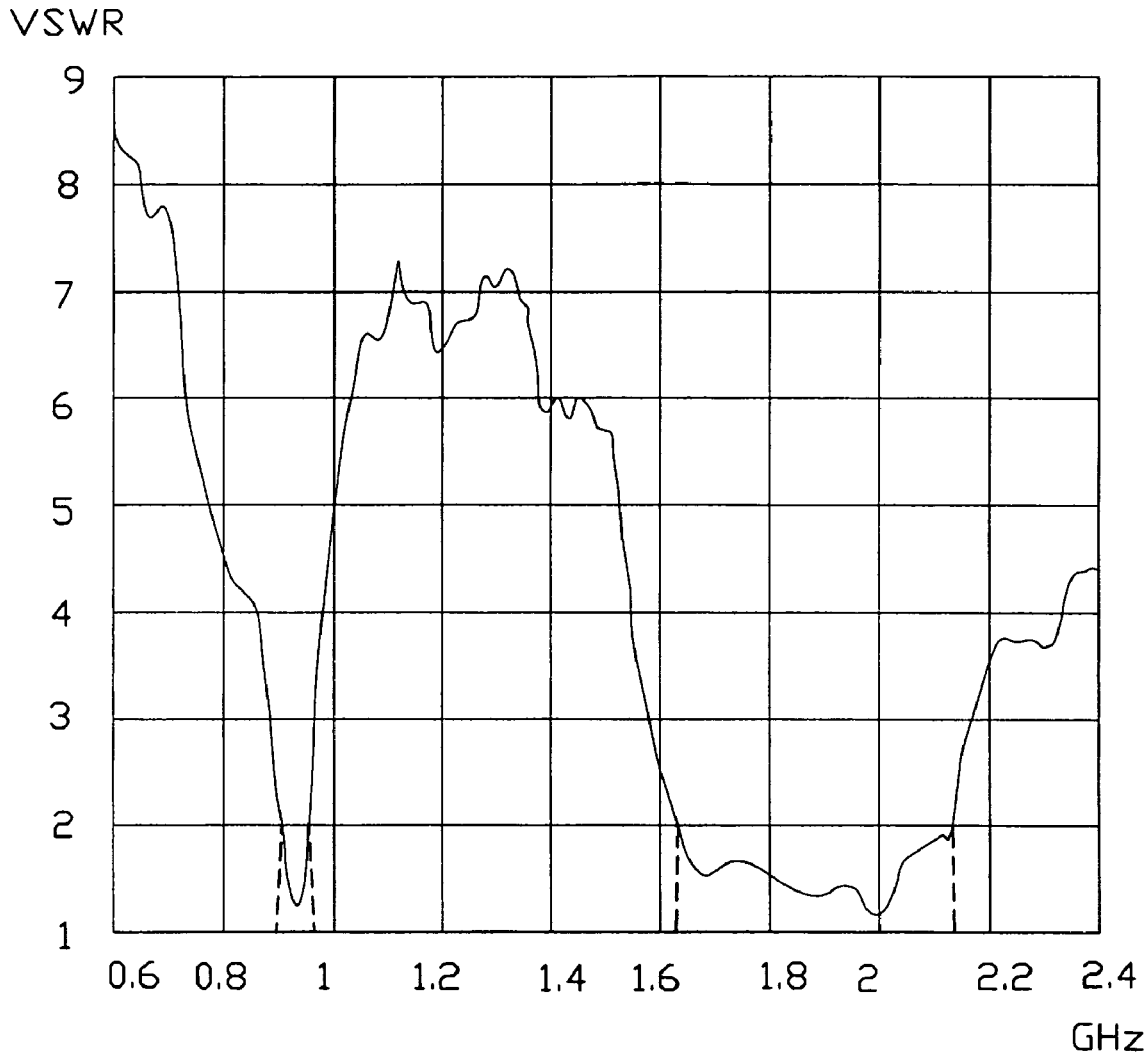
FIG. 9 is a test chart recording of Voltage Standing Wave Ratio (VSWR) of the multi-band antenna as a function of frequency.

Referring to FIG. 9, sets forth a test chart recording of Voltage Standing Wave Radio (VSWR) of the multi-band antenna 1 as a function of frequency. Note that VSWR drops below the desirable maximum value "2" in the 880-940 MHz frequency band and in the 1620-2180 MHz frequency band, indicating acceptable efficient operation in these two wide frequency bands, which cover more than the total bandwidth of GSM (low frequency includes 880-960 MHz, high frequency band includes 1710-1880 MHz) and be provided with more wider frequency band of the operating at high frequency.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A multi-band antenna adapted for used in a portable electronic device, comprising:

a grounding element;

a radiating element comprising a first radiating section substantially operating around 900MHz frequency band and a second radiating section substantially operating around 1800MHz frequency band; and a connecting element connecting the radiating element and the grounding element; and wherein the grounding element, the first radiating section, and the second radiating section are respectively located in different planes wherein the grounding element comprises a main body and a stretching section extending from the main body and located in a plane perpendicular to that of the main body.

2. The multi-band antenna as claimed in claim 1, wherein the main body is of a inverted-F shape defining a short edge and a long edge, the stretching section extending from the long edge of the main body.

3. The multi-band antenna as claimed in claim 2, wherein the connecting element and the main body of the grounding element locates in a first plane and the connecting element extends from the short edge of the main body along a longitudinal direction.

4. The multi-band antenna as claimed in claim 3, wherein the common radiating arm connects with left ends of the first and second radiating arm and comprises a first side branch and a second side branch.

5. The multi-band antenna as claimed in claim 4, wherein the first radiating arm extends away from the second side branch element and locates in the second plane as that of the second side branch.

6. The multi-band antenna as claimed in claim 4, wherein the second radiating arm comprises a first side arm and a second side arm, and where in the first side arm extends from opposite edge of the second side branch along a direction opposite to that of the first radiating arm and locates in the second plane as that of the second side branch and the radiating arm, the second side arm is of L-shape and extends from the first side arm to be located in a third plane parallel to the first plane and perpendicular to the second plane.

7. The multi-band antenna as claimed in claim 2, wherein the first, radiating section comprises a first radiating arm and a common radiating arm, the second radiating section comprises a second radiating arm and said common radiating arm.

8. The multi-band antenna as claimed in claim 7, wherein the first side branch is located in the first plane and connects to the connecting element; the second side branch extends upwards from the first side branch and is located in a second plane.

9. The multi-band antenna as claimed in claim 7, wherein a feeding point locates at the joint of the connecting element and the first side branch.

10. The multi-band antenna as claimed in claim 2, wherein a slot is formed between the connecting element and the stretching section.

11. The multi-band antenna as claimed in claim 10, wherein a feeding line comprises an inner conductor electrically connected to the joint and a braiding layer electrically connected to the grounding element.

12. A multi-band antenna adapted for used in a portable electronic device, comprising:

a grounding element;

a radiating element comprising a first radiating element section and a second radiating section; and a connecting element connecting the radiating element and the grounding element; and wherein the connecting element connects to both said first radiating section and said second radiating, and a first slot is defined between the connecting element and the first radiating section, and a second slot is defined between the first radiating section and the second radiating section wherein the connecting element is parallel to the second radiating section while perpendicular to the first radiating section.

13. The antenna as claimed in claim 12, wherein the first radiating section is of a strap configuration and the second radiating section is of an L-like configuration.

14. The antenna as claimed in claim 12, wherein a third slot is formed between the connecting element and the grounding element.

15. The antenna as claimed in claim 12, wherein the first slot and the second slot extends along one longitudinal direction toward an exterior while the third slot extends along an opposite longitudinal direction.

16. An multi-band antenna comprising:

a grounding element having an L-shaped configuration from a side view, having a first long side and a first short side;

a radiating element having another L-shaped configuration from said side view, having a second long side and a second short side; and said radiating element connected to the grounding element via a connecting element; wherein the first long side and the second long side are parallel to and overlapped with each other, and the first short side and the second short side are parallel to each other while offset from each other without overlapping and essentially located by two opposite sides of said overlapped first long side and second long side.

17. The antenna as claimed in claim 16, wherein said radiating element defines first and second radiating sections respectively located on the second long side and the second short side.

* * * * *